US005491475A

United States Patent [19]

Rouse et al.

[11] Patent Number: 5,491,475

[45] Date of Patent: Feb. 13, 1996

[54] MAGNETOMETER VEHICLE DETECTOR

[75] Inventors: Gordon F. Rouse, Arden Hills; William M. Volna, Minneapolis, both of Minn.

[73] Assignee: Honeywell Inc., Minneapolis, Minn.

[21] Appl. No.: 34,440

[22] Filed: Mar. 19, 1993

[51] Int. Cl.[6] ..... G08G 1/01

[52] U.S. Cl. ..... 340/933; 340/941; 340/939; 340/665; 324/244; 324/655; 364/436

[58] Field of Search ..... 340/933, 939, 340/940–943, 665, 666; 324/244, 207.15, 207.21, 207.23, 242, 243, 244, 245, 251, 256, 655; 364/436–438

[56] References Cited

U.S. PATENT DOCUMENTS

| | | | |
|---|---|---|---|
| 3,775,742 | 11/1973 | Koerner et al. . | |
| 3,825,889 | 7/1974 | Koerner . | |
| 3,832,704 | 8/1974 | Kardashian | 340/665 |
| 4,449,115 | 5/1984 | Koerner | 340/941 |
| 4,668,951 | 5/1987 | Duley et al. | 340/941 |
| 4,680,717 | 7/1987 | Martin | 340/941 |
| 4,839,480 | 6/1989 | Bickley | 340/666 |
| 5,008,666 | 4/1991 | Gebert et al. | 340/933 |
| 5,153,525 | 10/1992 | Hoekman et al. | 340/941 |
| 5,255,442 | 10/1993 | Schierbeek et al. | 324/252 |

FOREIGN PATENT DOCUMENTS

| | | |
|---|---|---|
| 0262621 | 4/1988 | European Pat. Off. . |
| 3521655 | 1/1987 | Germany . |
| 2236399 | 4/1991 | United Kingdom . |
| 9313386 | 7/1993 | WIPO . |

*Primary Examiner*—Donnie L. Crosland
*Attorney, Agent, or Firm*—John Shudy, Jr.

[57] ABSTRACT

A magnetometer vehicle detector for detecting various parameters of traffic on a roadway. A number of sensors, having a compact package, along with connecting cables, may be placed in road way with a small number of standard width sawcuts. Alternatively, sensors may be placed in the roadway within tubes under the external surface of the roadway. The package design of the sensor is such that the sensor can be placed in the sawcut or tube only in a certain way or ways resulting in the most sensitive axis of the sensor being most likely affected by just the traffic or vehicles desired to be detected and measured. The sensor may be a magnetoresistive device having a permalloy magnetic sensing bridge. Multiple sensors may be placed in single or multiple lanes of the roadway for noting the presence of vehicles and measuring traffic parameters such as average speeds, vehicle spacings, and types and numbers of vehicles. Such information is processed from the shapes, times and magnitudes of the signature signals from the sensors.

7 Claims, 14 Drawing Sheets

MAGNETOMETER VEHICLE DETECTOR

BACKGROUND OF THE INVENTION

This invention pertains to roadway vehicle detectors, and particularly, the invention pertains to magnetometer detectors for detecting vehicles on roadways.

Present traffic vehicle detectors consist of wire loops that act as an electrical inductor, along with a capacitor, in an oscillator circuit that detects the presence or absence of a vehicle such as an automobile, truck or bus. This kind of detection system requires the wire loop to be installed below the pavement by the insertion of the loop into typically eight saw cuts into the surface of the pavement. The four-sided loop must be about four feet on a side to provide enough sensitivity to detect smaller vehicles.

The failure rate of wire loops themselves is unacceptably high. The failures are the result of pavement upheaval and the differential in coefficients of thermal expansion between the pavement material and the wire. The wire breaks when the temperatures go too high or too low. A failure of the wire loop requires the installation of a replacement loop which is offset in location with respect to the first loop which has failed. This offset location is used because it is quite difficult to repair an in-place loop. However, having to offset the replacement loop causes some loss of optimum placement which results in some loss of vehicle detection accuracy and certainty.

Traffic engineers who use wire loops for obtaining information, not only want presence information, but want to obtain other information, including vehicle count, speed, headway or direction, occupancy, and identity. Vehicle count is obtainable with a wire loop, but obtaining speed from a single loop is not feasible since speed is determined by the time it takes a vehicle to pass between two points. Two loops do not provide sufficient time resolution of passing vehicles for obtaining accurate speed indications. Headway is a spacing between vehicles in the same lane and the present loops do not have the spatial resolution to determine vehicle spacing, particular vehicles at close distances from one another, with useful accuracy. Occupancy is the measure of the presence of a vehicle in a lane, whether moving or stationery. Present wire loop detectors are poor for accurately detecting vehicles below a certain speed thereby not being always able to detect traffic that has come to a standstill. Further, wire loops also are incapable of providing information about the type of vehicle passing over the loop since the measurement coil cannot resolve the vehicle features, especially if detection signals have relatively low signal-to-noise ratio characteristics.

SUMMARY OF THE INVENTION

The invention involves placing one or more magnetometers, particularly magnetoresistive detectors, in each lane of a roadway or highway. These detectors are laid in a standard saw cut groove in the highway or may be inserted under the highway through a tube installed across the road bed under the pavement. The magnetoresistive transducer is advantageous in view of other magnetometer approaches. The magnetoresistive sensor is a permalloy magnetometer which is small and can be made to fit within a standard-width pavement saw-cut. Multiple permalloy magnetometers can be fabricated on one cable and spaced at pre-measured separations for measuring particular kinds of parameters of vehicles. The permalloy magnetoresistive sensor is a solidstate sensor. It can be produced at very low cost. Unlike some related-art fluxgate magnetometers, the transducer support electronics of the present magnetoresistive sensor is packaged within the magnetometer unit; and wire loops have added loss of sensitivity as multiple loops are added on the same cable in an installation.

The advantages and features of a magnetometer in contrast to a wire loop detector are numerous. A magnetometer can be functional on bridge decks having steel present and where cutting of the deck pavement for a loop is not permitted. The magnetometer survives better in crumbly pavements for a longer period of time than an ordinary wire. A magnetometer requires fewer pavement cuts and significantly fewer linear feet of cut for roadway installation. The magnetometers have much higher sensitivity (i.e, they can detect bicycles) than a wire loop sensor. Such higher sensitivity provides for a high signal-to-noise ratio thereby resulting in the collection of more accurate data. A magnetometer can separately detect two vehicles spaced only about a foot apart. Also, motion of the vehicle is not required for an magnetometer to accurately sense the vehicle. With shallow placement of a magnetometer, identification of vehicles according to types or models can be attained from the different magnetic signatures that occur as major components of a vehicle pass over the magnetometer.

DESCRIPTION OF THE PREFERRED EMBODIMENTS

Figure 1:
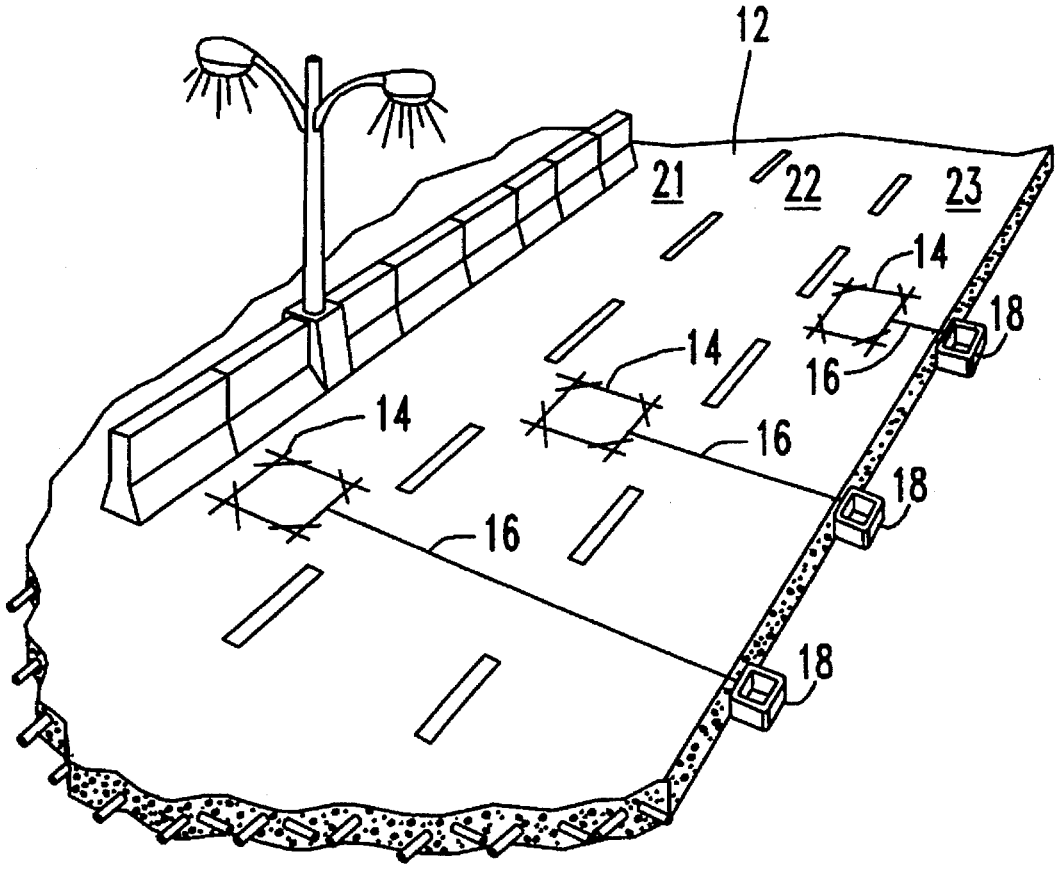
FIGURE 1 PRIOR ART
FIG. 1 illustrates a typical roadway installation of wire loop detectors of the related art.

FIG. 1 illustrates the typical roadway 12 installation for loop detectors 14. Loop 14 requires four pavement sawcuts of at least four feet long and four corner pavement sawcuts of about one foot long each in order to accommodate the laying down of the wire coil for sensor 14. Also, there is required a long pavement cut 16 from the edge of roadway 12 to loop 14 of which for interlane groups the pavement cut may cross one or more other lanes of roadway 12.

Figure 2:
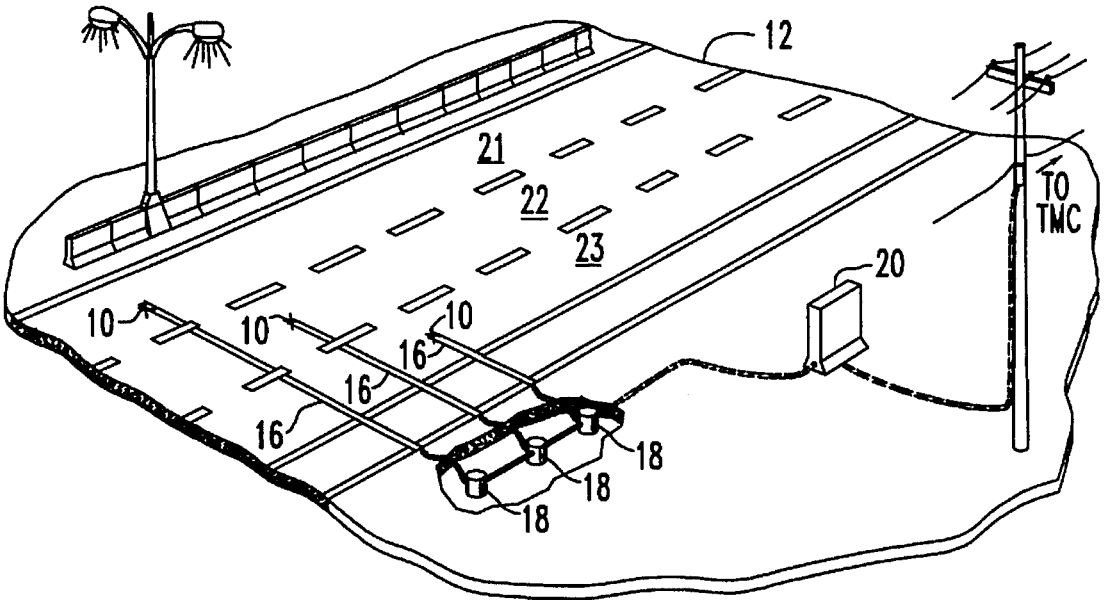
FIG. 2 reveals a roadway installation of the present invention.

FIG. 2 shows an installation of one configuration of the present invention 10 on roadway 12. One magnetoresistive (MR) sensor 10 is installed per lane. MR sensor 10 is connected to the edge of the roadway via a sawcut slot 16 with a connection wire to the hand hole 18 for each of the lanes 21, 22 and 23. The lines from the sensors go from hand holes 18 to controller 20 which may be a '386 Dell computer acquisition system which is a standard model 170 controller/emulator. From system 20 the line goes onto a traffic management center.

Figure 3:
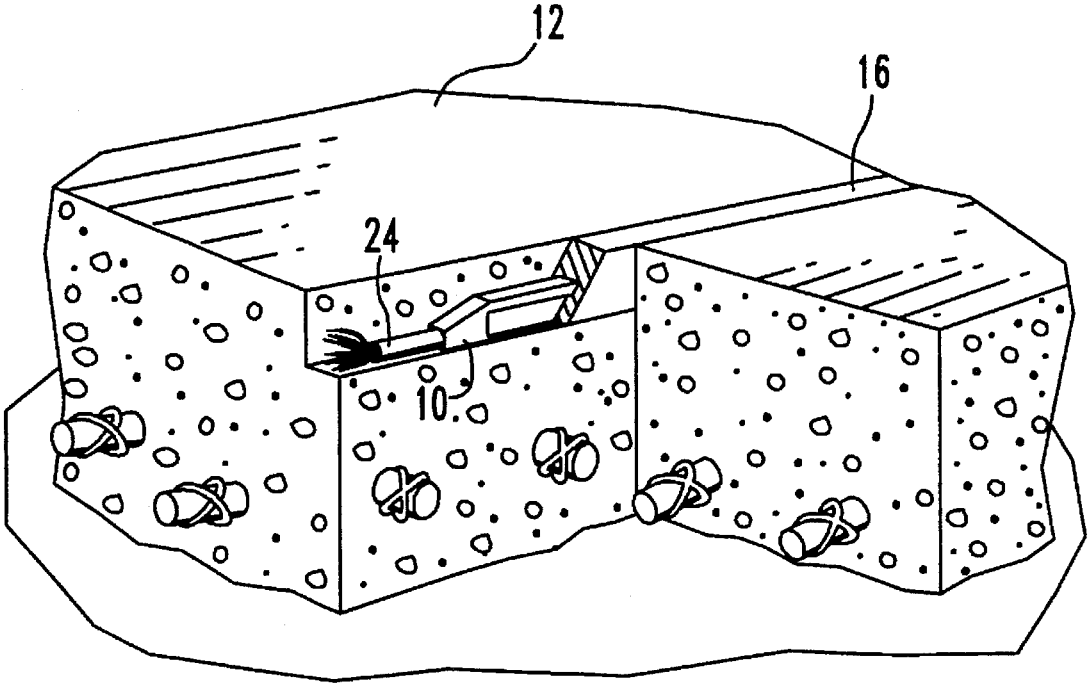
FIG. 3 illustrates an installation of a magnetoresistive sensor in a roadway.
Figure 14:
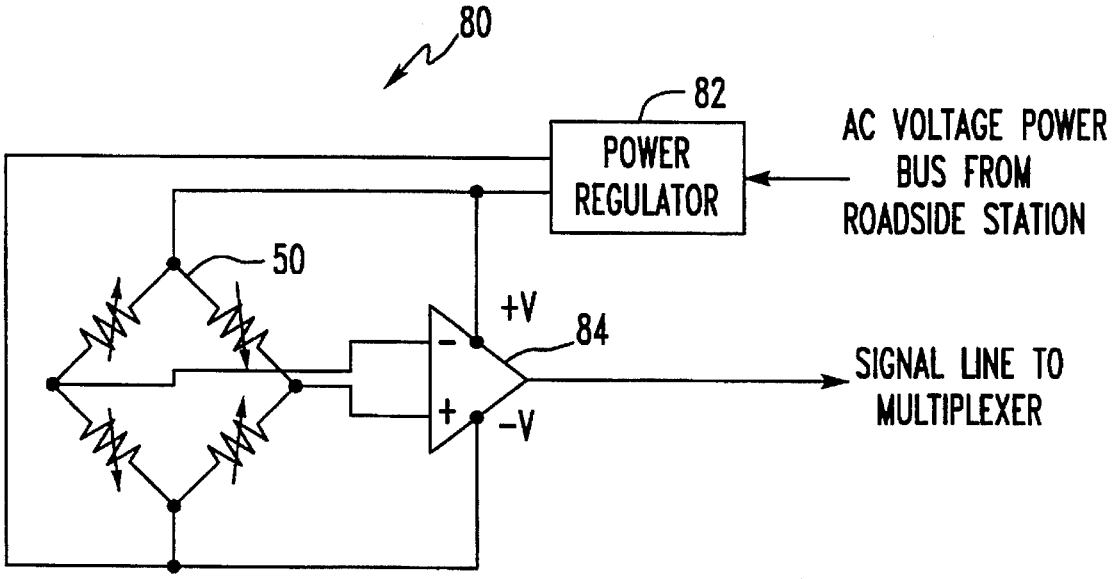
FIG. 14 is a diagram of an open-loop magnetoresistive sensor.

FIG. 3 is a closer view of the installation of an MR sensor 10 embedded in roadway 12. A standard diamond saw cut slot 16 in roadway 12 is about ¾ to 1 inch deep and ⅜ inch wide. This is sufficient for inserting MR detector 10 which is about ¼ inch wide, 5/16 inch deep and 2 inches long. Once detector 10 and its corresponding connection leads 24 are inserted in slot 16, then slot 16 is filled in with an epoxy filler or other suitable material. Sensor 10 is physically quite small, especially if an open-loop magnetometer approach 80 of FIG. 14 is used. A single-axis sensor 10, oriented in the vertical direction to intercept the maximum component of earth's field, provides good vehicle signatures. The length of cable 24 is not critical. Sensors 10 can withstand the full range of weather conditions, including temperature extremes, water, and various chemicals.

Figure 4A:
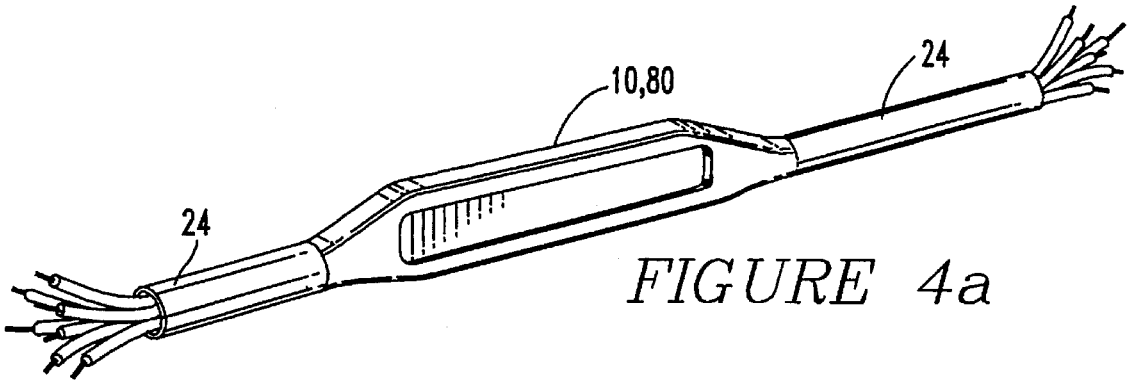
FIGS. 4*a*–4*c* reveal the packaging of magnetoresistive sensors utilized in a roadway.
Figure 4B:
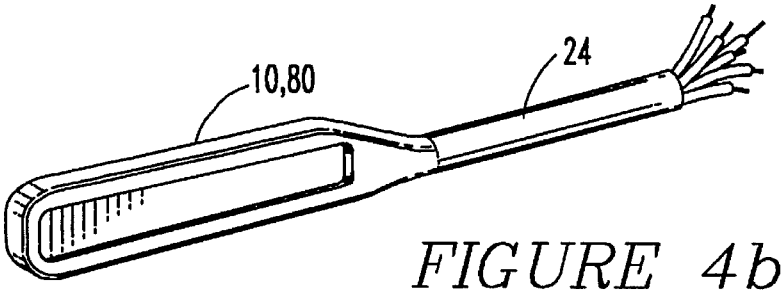
Figure 4C:
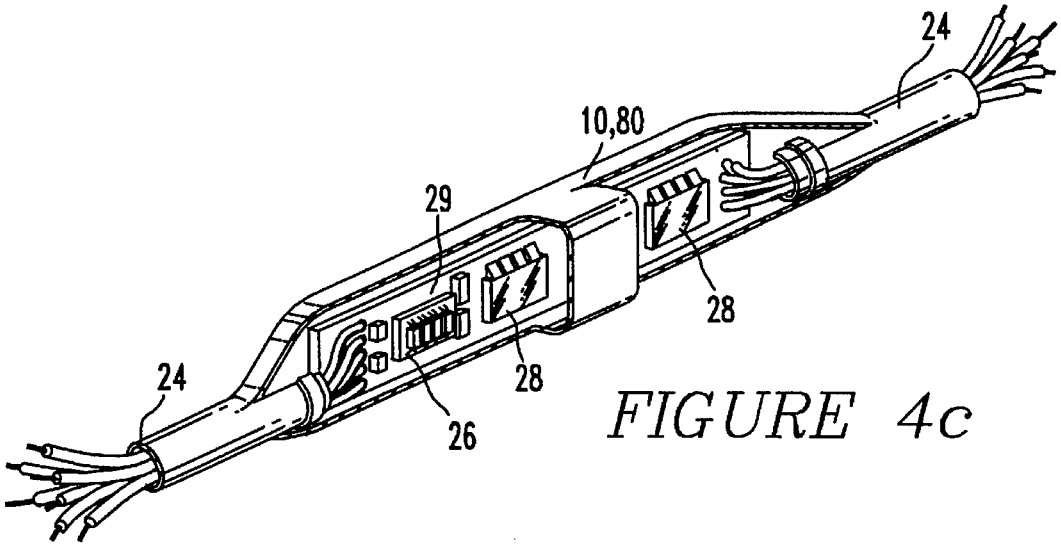

FIGS. 4*a–c* illustrates package types of the MR sensor 10. The package of the sensor 10 is designed so that the sensor fits only in a vertical position, the most sensitive axis is situated in the direction of the vehicles to be detected, in a standard sawcut 16 of roadway 16 that sensor 10 is to be embedded in. FIG. 4*a* shows the packages for an in-line MR sensor 10 and FIG. 4*b* shows an end-unit MR sensor 10. FIG. 4*c* indicates the arrangement of the contents in MR sensor 10. Shown in sensor 10 of FIG. 4*c* are permalloy magnetic sensor 26 and integrated circuits 28.

Figure 5:
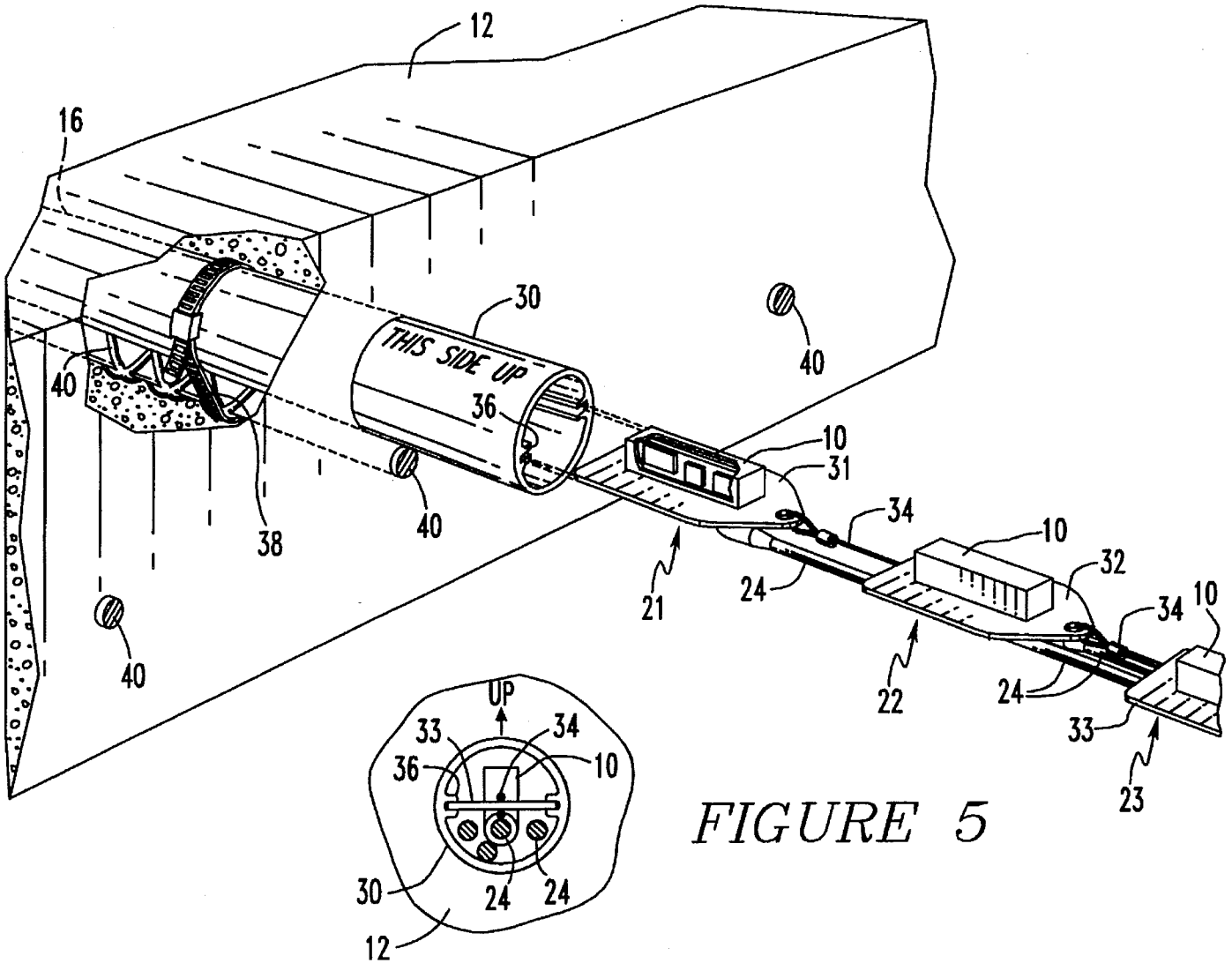
FIG. 5 illustrates the use of a tube used for the situating of magnetoresistive vehicle sensors in a roadway.

FIG. 4*c* reveals a single permalloy transducer 26, with signal-conditioning and data-communication electronics 26 on a small, narrow printed wiring board 29. Board 29 is attached and sealed to cable 24 with epoxy, neoprene, polyurethane or other suitable potting material. Multi-wire cable 24 provides both power and signal paths for sensors 10. Sensor 10, mounted on the cable, is small enough to fit within the standard ⅜ inch wide slot as shown in FIG. 5. For each of lanes 21, 22 and 23, three of these sensors 10 are strung along the same cable 24 and share common power lines. Sensors 10 are be spaced a few feet apart to generate the time-delayed signatures needed to determine the vehicle length and speed.

FIG. 5 illustrates another installation approach which employs a standard schedule 40 or custom extruded PVC tube 30 installed across roadway 12. Tube 30 has internal diametrical guide slots 36 to carry and maintain the position of detector boats 31, 32 and 33 in a vertical position relative to the horizontal surface of roadway 12. Extruded PVC (plastic) pipe 30 may be pre-installed during a pavement pour of the highway. Sensors 10 may be installed later. In an existing roadway 12, wide slots may be cut and the pipe or tube may be dropped into slot 16 and covered with an epoxy, concrete or other filler. The advantage of this kind of installation is that MR sensors 10 may be removed from tube 30 at the edge of roadway 12 to perform maintenance or add more MR sensors 10. Sensors 10 are situated on lane boats 31, 32 and 33 which are to be positioned under lanes 21, 22, and 23, respectively. The lane boats are connected with 1/16th inch stainless steel cable for detector 10 boat 31, 32 or 33 entry or withdrawal from tube 30. Boats 31, 32 and 33 slide into tube 30 along guiding slots 36. Connected to respective sensors 10 are detector leads 24 for conveyance of signals and power. When tube 30 is laid on a concrete roadway 12 bed it may be tied down with nylon tie 38 to a reinforcement bar 40 to prevent float of tube 30 during the fill of roadway 12 with concrete or other substance.

Figure 6:
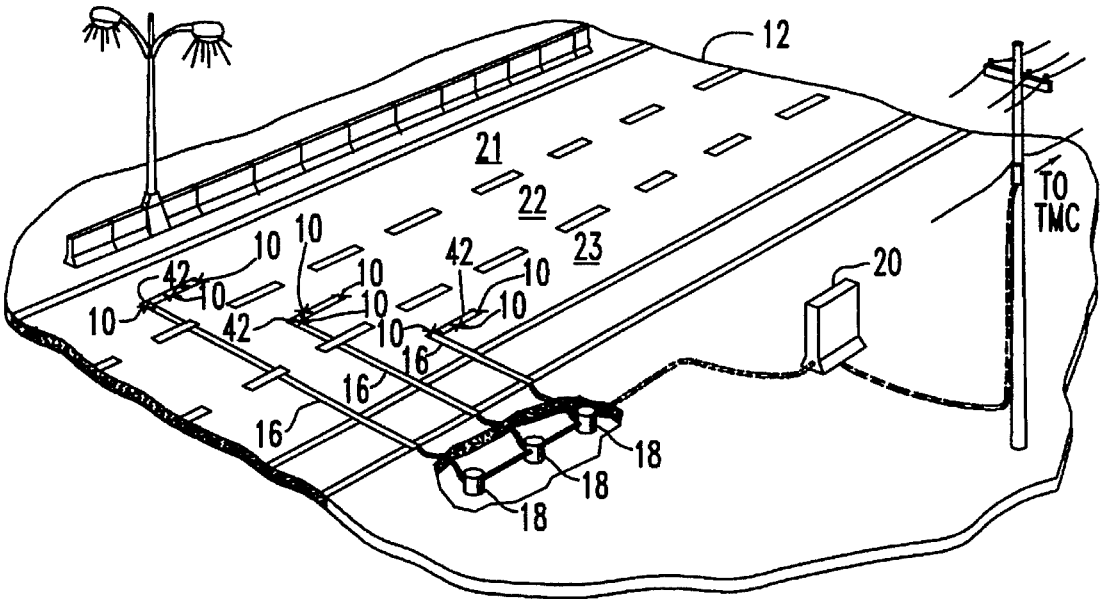
FIG. 6 shows the layout for installation of multiple magnetoresistive sensors.

FIG. 6 reveals the sensor layout for roadway 12 wherein multiple sensors 10 exist for each of lanes 21, 22 and 23 of roadway 12. At most, each lane requires two slots 16 and 42. Slot 16 provides a way for sensor lead 24 from hand hole 18 to slot 42 which incorporates three sensors 10 in a line parallel to its respective lane 21, 22 or 23. Each of all the lanes have three sensors. However, multiple sensors 10 for each lane may instead incorporate two or four or more MR sensors 10. Multiple sensors for each lane can provide extensive traffic information such as vehicle length, speed and headway. The sensitive axes of sensors 10 are aligned in the vertical direction or a direction perpendicular to the surface of roadway 12. Sensors in slot 42 are spaced at specific distances (e.g., 1 to 5 yards) apart so as to generate the time-delayed signatures sufficient to determine vehicle length and speed. As a vehicle passes over each MR sensor, it generates a signal "shadow". With all of sensors 10 in slot 42 for a given lane, 21, 22 or 23, connected to a data station 20 via sensor leads 24 along slots 16 and through hand holes 18 onto data station 20, a signal processor uses a threshold level to differentiate between vehicles in the lane of the monitored sensors 10 and the vehicles in the other lanes and to minimize the likelihood of "false alarms".

Figure 7:
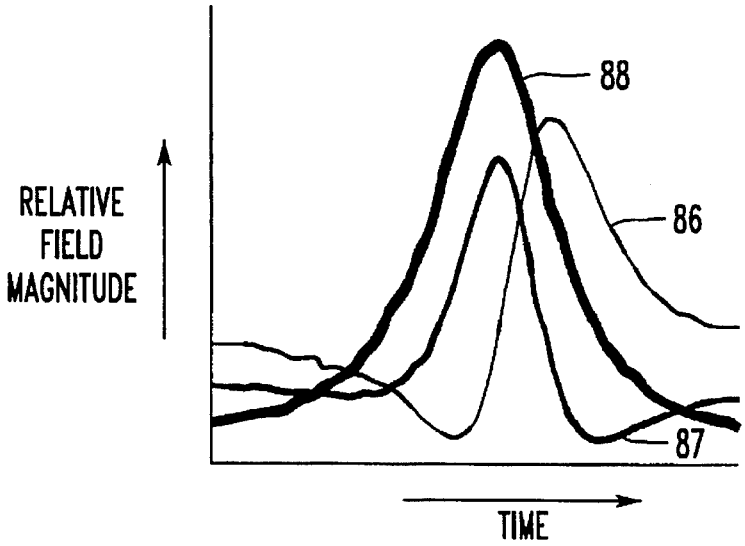
FIG. 7 is a set of signals from a three-axis magnetometer sensor caused by a vehicle passing over the sensor.

FIG. 7 shows the three magnetic components Bx, By, and Bz which are labelled 86, 87 and 88, respectively, of a truck passing a three-axis magnetometer 10 from a distance of greater than 50 feet from roadway 12. Signatures 86, 87 and 88 are similar in shape, but are much larger in amplitude and detail when a magnetometer is placed within roadbed 12. For this application, where the size and cost of sensor 10 are a high priority, using only the z-axis signal 88 (Bz) provides high-integrity information to identify vehicle count, speed, headway, occupancy, and types of vehicles.

Figure 8:
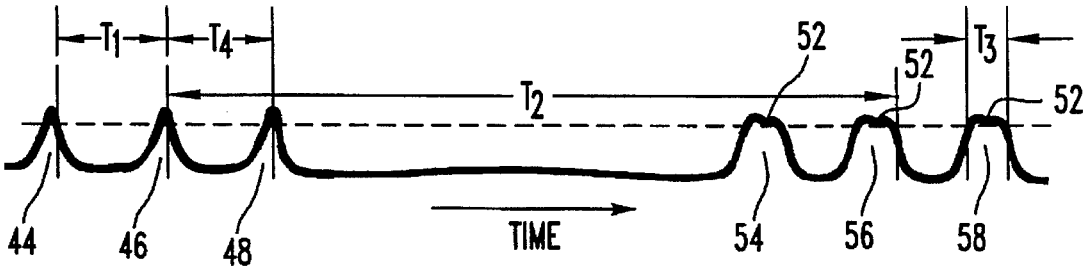
FIG. 8 is an example of vehicle signatures from a linear array of single-axis magnetoresistive sensors.

FIG. 8 shows an example of vehicle signatures from a linear array of single axis MR sensors in slot 42 for a given lane. Time period $T_1$ may be used to determine the speed of a vehicle passing over sensors 10, since the sensors 10 spacing is known. Vehicle speed may be confirmed and made more accurate by repeating the measurement of time $T_4$ between "shadows" 46 and 48. The time differential between shadows 46 and 48 should be approximately the same as the time differential between shadows 44 and 46.

Time period $T_2$ in FIG. 8 may be used to determine the headway between vehicles, and since there are multiple signatures, the headway measurement may be corroborated. Vehicle count and roadway occupancy by vehicles can be tabulated versus time by using a real-time clock 91 in system controller 20 of FIG. 11. Computer 20 may accumulate data for a fixed period of time and then the data, at the computer operator's convenience, may be transferred, already tabulated in a "demographic" data format to a remote station 92 via a telephone-modem link.

The width of each of the signature shadows, 44, 46, 48, 54, 56 and 58, correlate directly with vehicle size or length. It is evident that shadows 44, 46 and 48 reveal a vehicle length or size substantially shorter than that of shadows 54, 56 and 58. The shadows themselves can reveal an identification of particular vehicles since major components such as an engine, transmission and axles of a passing vehicle may reveal distinct signatures, depending on the amount of sensitivity, the amount ferrous metal present in the vehicle and the proximity of sensor 10. For instance, shadows 54, 56 and 58 have an indentation 52 which may represent space between two axles of a large vehicle passing over each of sensors 10. With a particular kind of magnetometers, it is possible to differentiate even between different types of trucks or other vehicles. $T_3$ is the signal period that represents the length of a vehicle. To get more detailed information, MR sensor 10 functions as a "point" sensor in that it generates a signal based on the magnetic field properties in a very localized region above sensor 10.

The algorithms of micro-computer 90 are adaptive to account for variations in the detected signatures due to various detector positions and kinds of installations. For example, the signature of a vehicle going north-south varies from its signature when the vehicle is going east-west. The software accounts for these differences without having to retrain the system for each sensor 10 installation. Typically, a vehicle's signal is well above the sensor's electrical noise. The coupling of the signature of a vehicle into the next lane sensor is every small, as shown in FIGS. 9*a–e* and 10*a–l*, so inter-lane cross-coupling is not a problem.

Figure 9A:
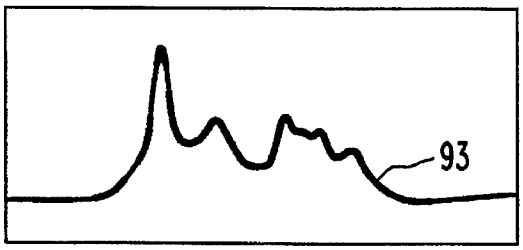
FIGS. 9*a*–9*e* are representative magnetometer signatures of a truck.
Figure 9B:
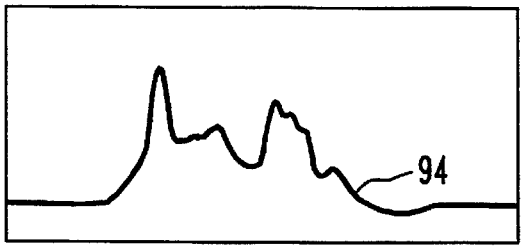
Figure 9C:
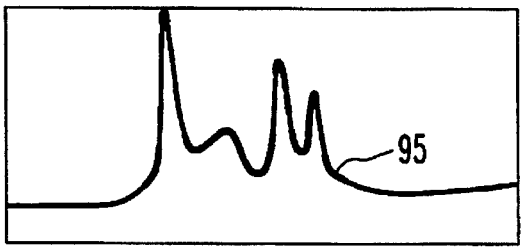
Figure 9D:
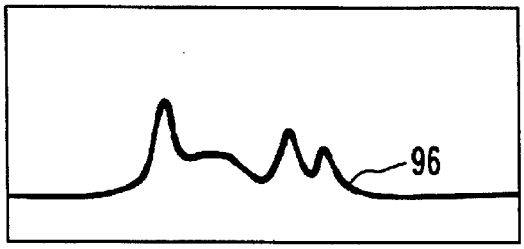
Figure 9E:
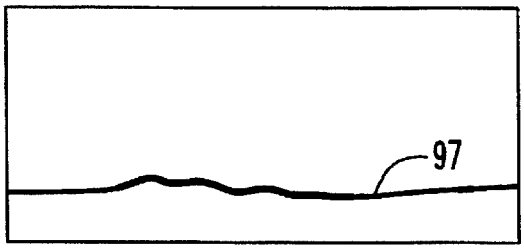

FIGS. 9*a–e* show representative sensor 10 signals caused by a five ton cargo truck traveling thirty miles per hours it passes over or near sensor 10. The front of the truck is to the left and the end of the truck is to the right. Curve 93 of FIG. 9*a* reveals the center of a truck passing over sensor 10. Curve 93 is a clear signature of the front axle and engine and then the undercarriage support. Curve 94 of FIG. 9*b* involves sensor 10 halfway between the truck center and the tire track. Curve 94 reveals almost no signal before or after the truck. Curve 95 of FIG. 9*c* is when the truck tires are passing over sensor 10. Curve 95 shows a clear signature of the front axle, the engine and the tandem axle. Curve 96 of FIG. 9*d* involves the truck tire track passing 1.5 feet away from sensor 10. Curve 96 can provide an estimate of the side position of the truck within the lane. Curve 97 of FIG. 9*e* shows the truck passing sensor 10 with the outside tire track three feet from sensor 10. Curve 97 indicates almost no signature detected in the traffic lane next to the lane of the truck.

Figure 10A:
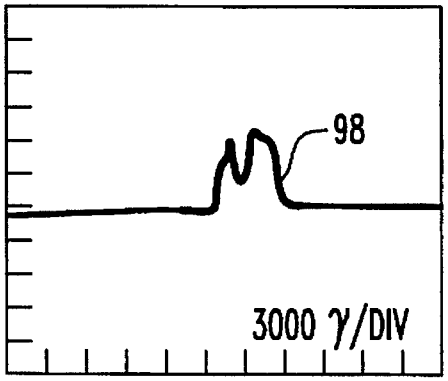
FIGS. 10*a*–10*l* are representative magnetometer signatures of various vehicles.
Figure 10B:
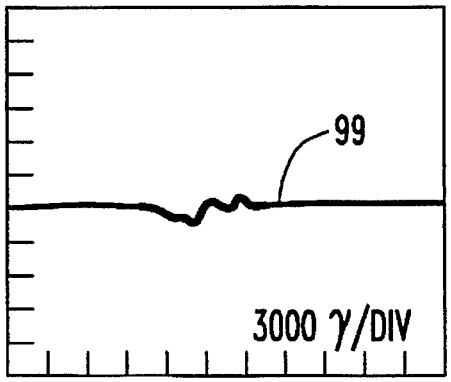
Figure 10C:
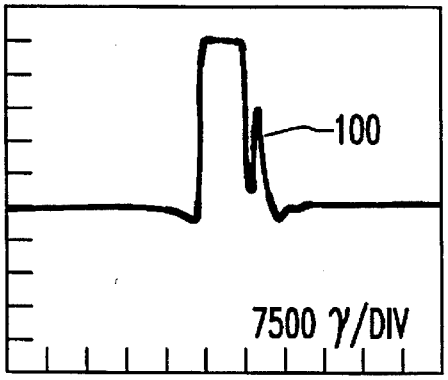
Figure 10D:
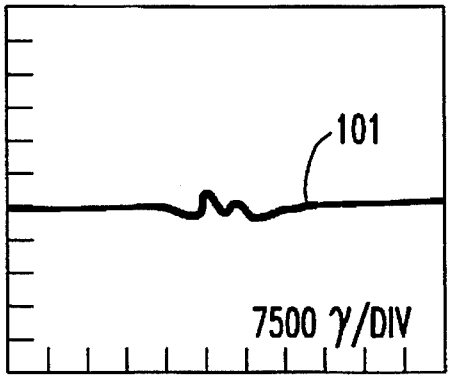
Figure 10E:
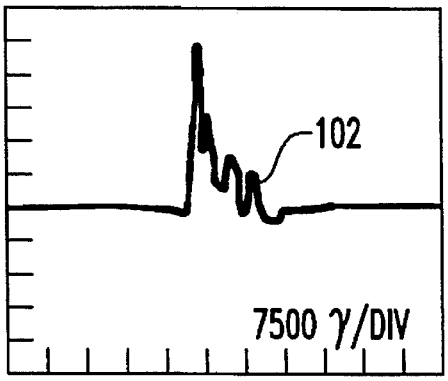
Figure 10F:
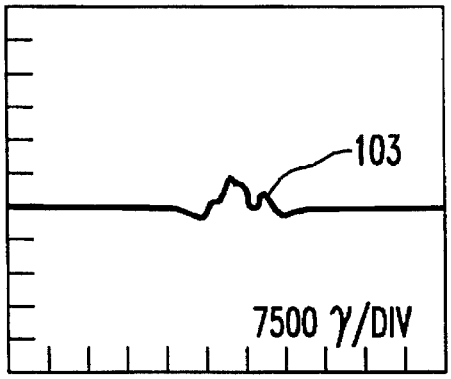
Figure 10G:
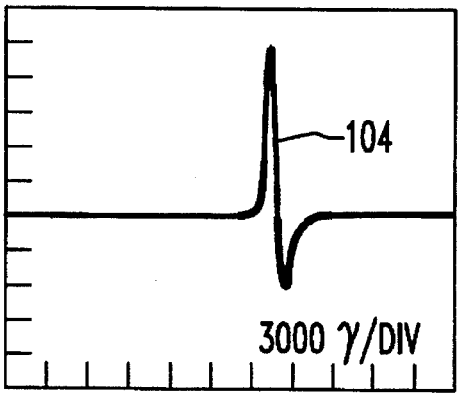
Figure 10H:
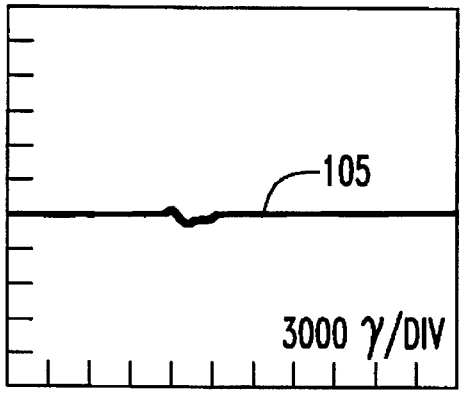
Figure 10I:
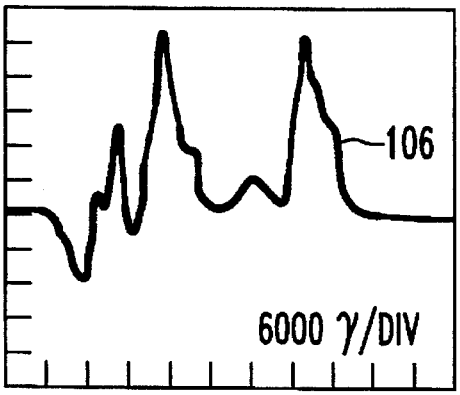
Figure 10J:
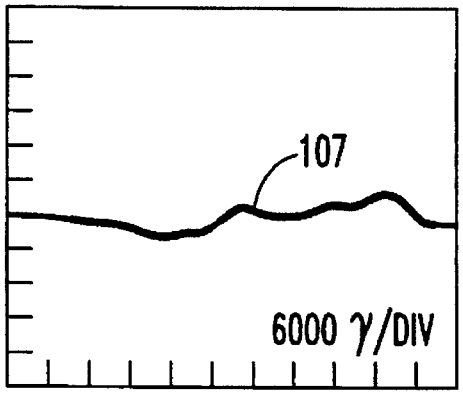
Figure 10K:
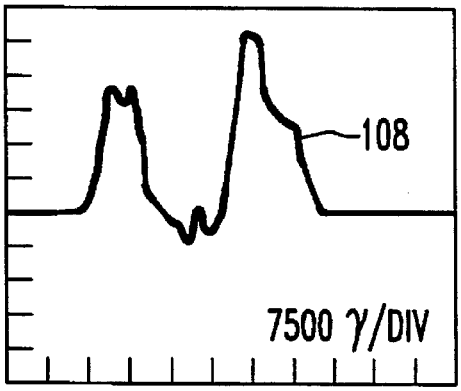
Figure 10L:
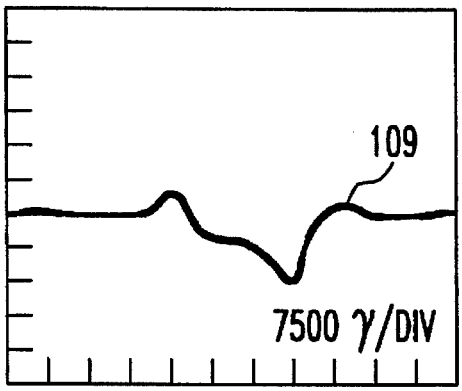

FIGS. 10*a–l* show representative signatures for various vehicles travelling 30 miles per hour. The front of the respective vehicles is to the left and the end of the vehicles is to the right. A vertical scale of one gamma equal $10^{-5}$ gauss for each signature is shown. Curve 98 of FIG. 10*a* is a signature of a VOLKSWAGEN having a rear-mounted engine, passing directly over sensor 10. Curve 99 of FIG. 10*b* is the signature from sensor 10 in a lane adjacent to the lane of the VOLKSWAGEN. Curve 100 of FIG. 10*c* is a signature of a VEGA station wagon having a front-mounted engine, passing directly over sensor 10. Curve 101 of FIG. 10*d* is the signature from sensor 10 in a lane adjacent to the lane of the VEGA. Curve 102 of FIG. 10*e* is a signature of a four-door FORD sedan passing directly over sensor 10. Curve 102 shows the engine in front followed by an undercarriage structure. FIG. 10*f* reveals signature 103 from sensor 10 in a lane adjacent to the lane of the FORD. Signature 104 of FIG. 10*g* is of a motorcycle. FIG. 10*h* shows signature 105 from sensor 10 in a lane adjacent to the lane of the motorcycle. FIG. 10*i* shows signature 106 of an eighteen-wheel semi-truck. Signature shows an engine in front followed by two main axle assemblies of the trailer. Signature 107 of FIG. 10*j* is from sensor 10 in a lane adjacent to the lane of the semi-truck. Signature 108 in FIG. 10*k* is of a city passenger bus having an engine in the rear and two axles. FIG. 101 shows signature 109 from a sensor in a lane adjacent to the bus.

Once the class of a vehicle is determined, the velocity, headway, and even the acceleration profile is determined by matching signatures from sensors 10 placed along the lane. The acceleration profile coupled with the terrain (i.e., going uphill, downhill, etc.) gives an indication of the load on the detected vehicle. Signature detection and analyses can provide various kinds of information about the detected traffic.

Figure 11:
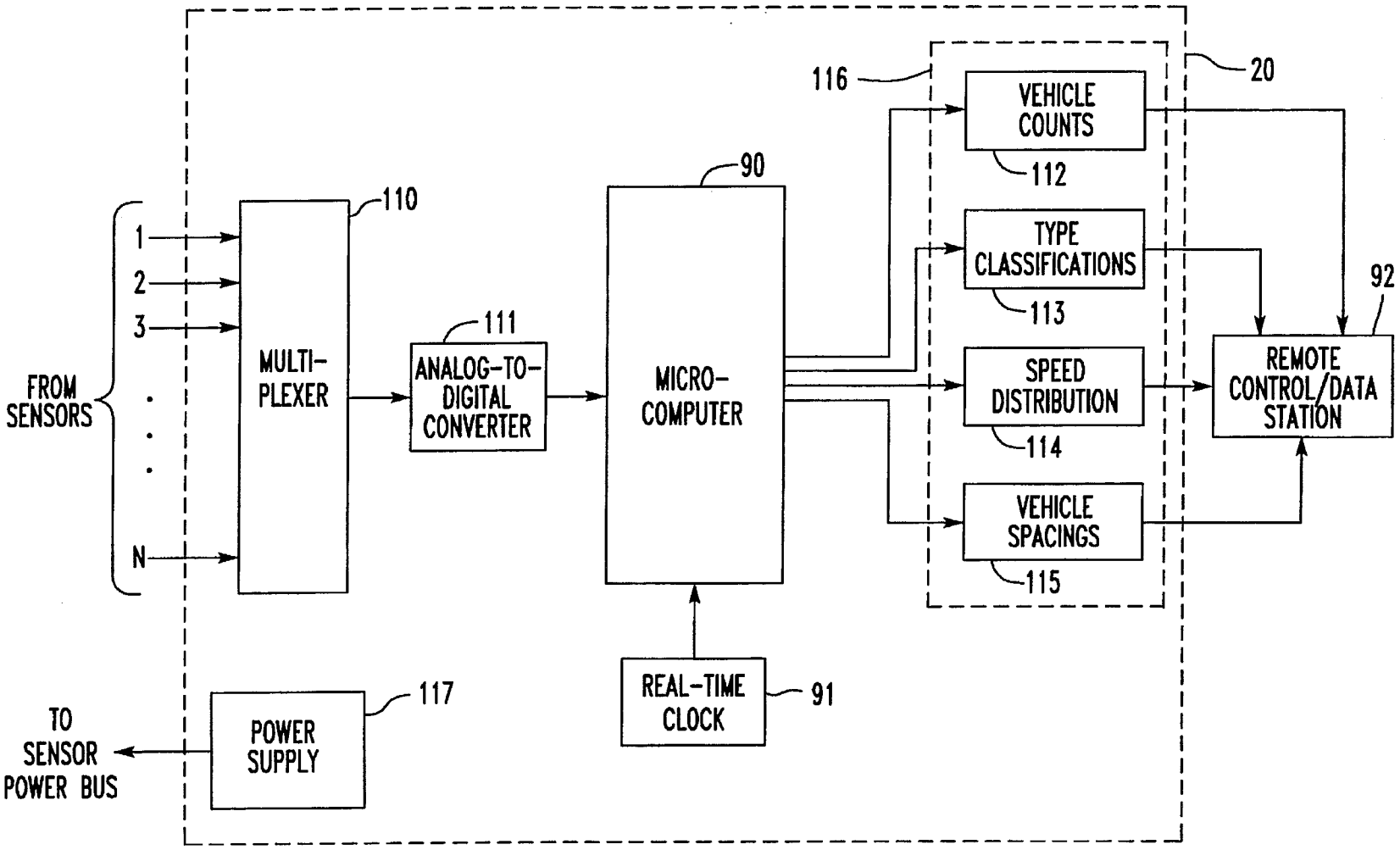
FIG. 11 is a block diagram of a magnetometer sensor controller.

FIG. 11 is a block diagram of controller 20 and remote control/data station 92. Controller 20 has inputs from sensor 10 to multiplexer 110. The sensor signals are multiplexed into one signal line to an analog-to-digital converter 111 for digitizing the signals for inputting into micro-computer 90 to be time-tagged and processed. Real-time clock 91 provides the timing basis for computer 90. The processed outputs of computer 90 include vehicles counts 112, vehicle type classifications 113, speed distributions 114, and vehicle spacings 115. Other parameter determinations may be processed. The outputs of computer 90 may go through a modem 116 in a parallel or serial format to be sent on to remote control/data station 92. Power supply 117 provides voltages to the sensor power bus.

Figure 12:
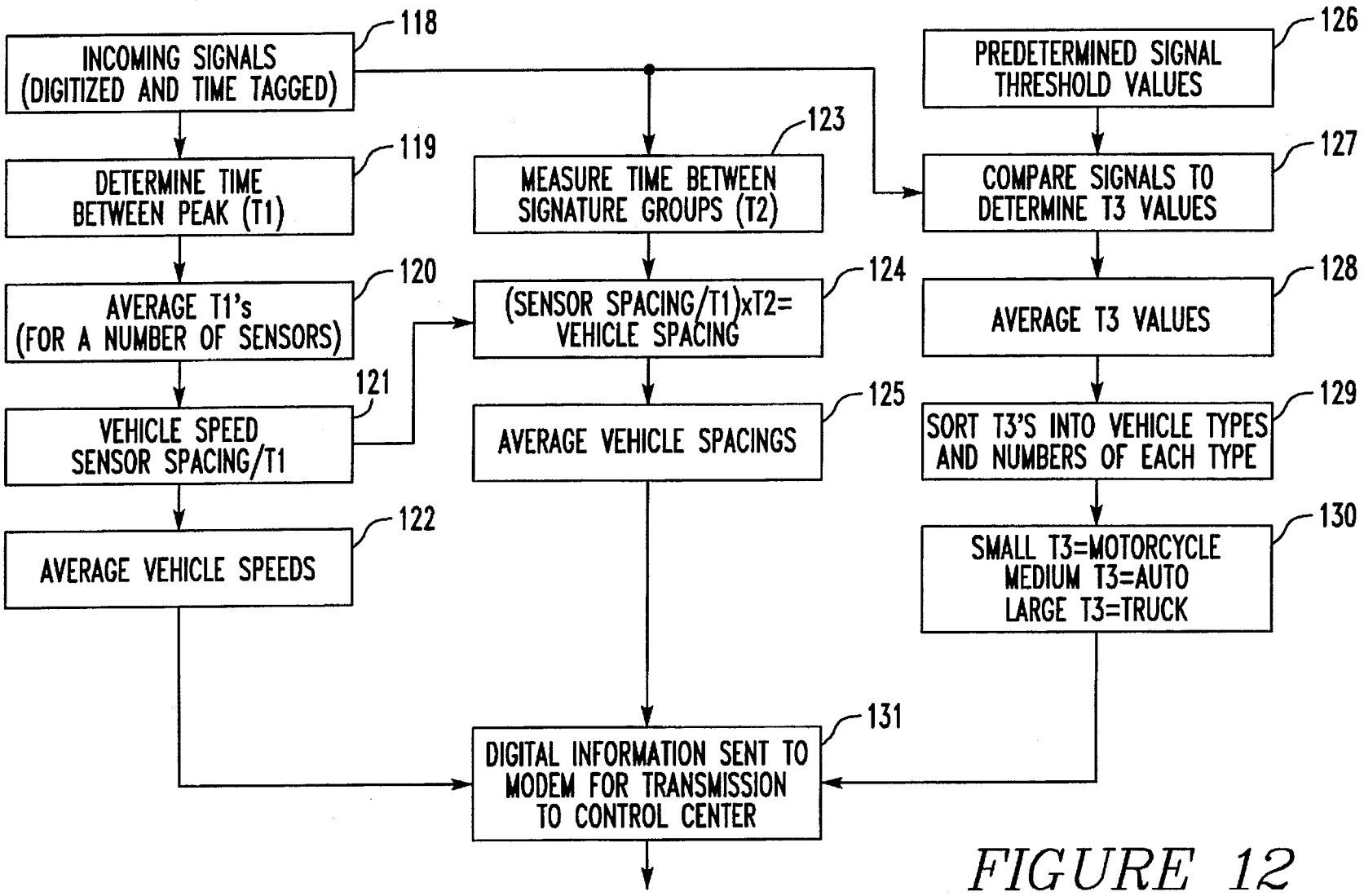
FIG. 12 is a signal processing block diagram of the controller micro-computer.

FIG. 12 shows the operations performed on the sensor 10 signals by micro-computer 90. Incoming signals 118 are digitized and time tagged. Signals 118 go to processing block 119 that determines the times (T1) between signal peaks 44 and 46 of the signals as illustrated in FIG. 8. Block 120 averages the T1's for a number of sensors 10. Then the vehicle speeds are determined by block 121 in accordance with sensor spacing/T1. Then the vehicle speeds may be averaged by processing block 122. Incoming signals 118 are also processed by block 123 which measures the times (T2) between signature groups 44, 46, 48 and 54, 56, 58, respectively, as illustrated in FIG. 8. Block 124 determines vehicle spacings by multiplying the vehicle speed or sensor spacing/T1 from block 121 by T2 from block 123 to obtain a vehicle spacing determination. The vehicle spacings from block 124 may be averaged by processing block 125. Block 126 provides predetermined signal threshold values which are compared with incoming signals from block 118 by block 127 to determine T3 values as illustrated in FIG. 8. The T3 values are averaged by block 128. The averaged T3 values are sent on to processing block 129 for sorting into vehicle types and determining the numbers of each type. Block 130 categorizes the vehicle types in various fashions in accordance of the kind of information that is desired. For instance, the T3 information may be categorized with small T3's representing motorcycles, medium T3's representing automobiles, and large T3's representing trucks. The digital information of average vehicle speeds from block 122, average vehicle spacings from block 125 and vehicle categorizations from block 130 may processed into parallel or serial format by block 131 for sending to modem 116 for transmission to control center or control/data station 92.

Figure 13:
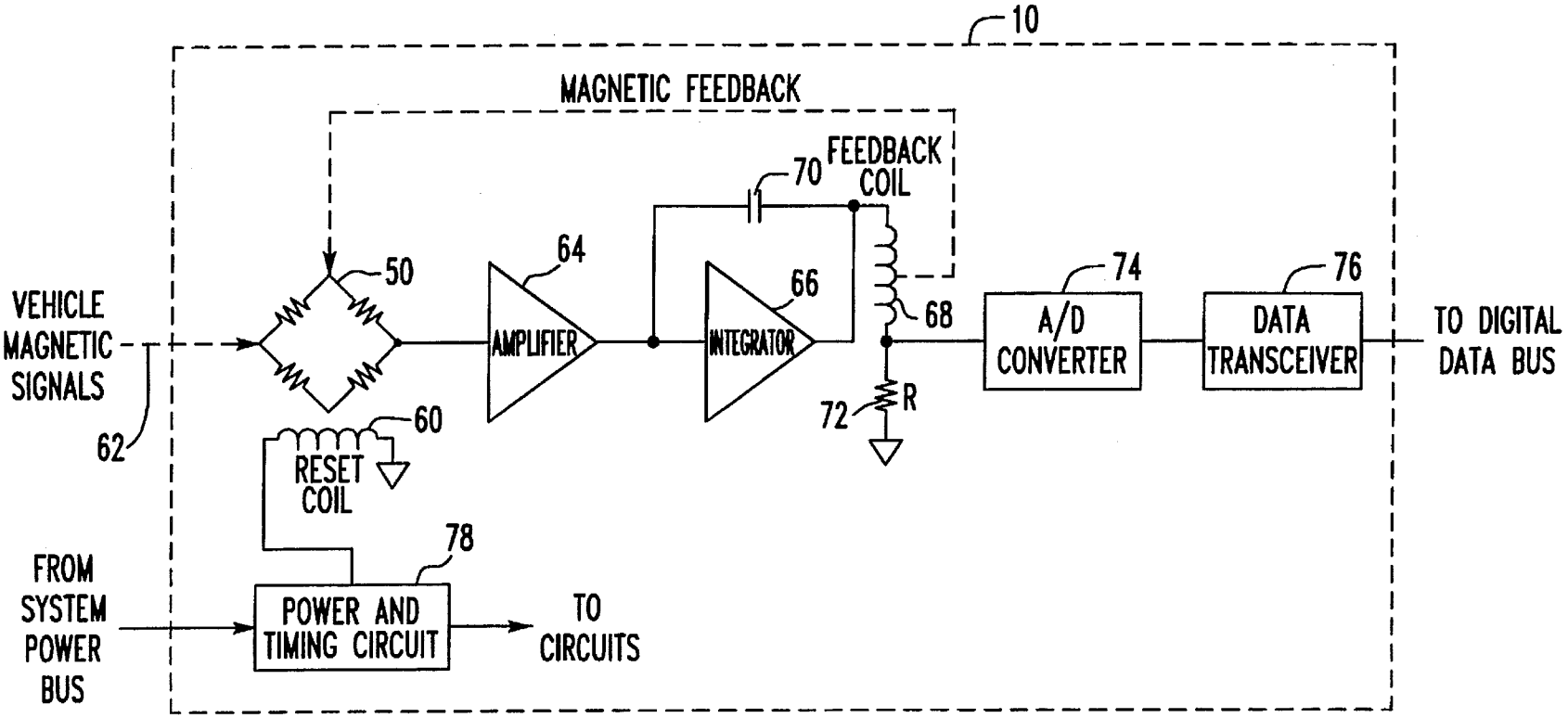
FIG. 13 is a diagram of a closed-loop magnetoresistive sensor.

FIG. 13 is a schematic of an example of a magnetoresistive sensor 10. Permalloy magnetoresistive sensing bridge 50 detects magnetic signals or field variations of a vehicle in the vicinity of sensor 50. Reset field coil 60, though not necessary, resets the magnetization of sensing bridge 50 to its easy axis direction. The switching of the magnetization of sensing bridge 50 is back and forth from 0 to 180 degrees with respect to the easy axis, so that sensor 50 output will be insensitive to thermal drifts and to offsets of bridge 50 in large magnetic fields. The output signals from bridge 50 due to vehicle magnetic signals 62, are enhanced by amplifier 64. The signals from amplifier 64 are integrated by integrator 66. Although sensor 10 can be an open loop system, Integrator 66 has an output that may be fed back through feedback coil 68 and through integrating capacitor 70 to the input of electronic integrator 66. A magnetic feedback from feedback coil is fed back to bridge 50. This magnetic feedback allows the output of sensing bridge 50 in a closed loop fashion. The closed loop configuration reduces cross-axis sensitivity and non-linearity, relative to magnetic signal 62, of the output of sensing bridge 50. Resistor 72 provides a load to integrator 66 output. Resistor 72 provides a particular scale factor in the coil-current-to-voltage conversion. The analog output of integrator 66 goes onto analog-to-digital (A/D) converter 74. The digital signal output of converter 74 goes to a data transceiver 76 which manages digital data that is sent onto the digital data bus of system 20. Power and timing circuit 78 conditions power from a system bus for all the circuits of sensor 10 and provides reset signals to coil 60 and timing signals to integrator 66, A-D converter 74 and data transceiver 76.

FIG. 14 shows a basic magnetoresistive sensor 80 having magnetoresistive bridge 50 and differential amplifier 84. Sensor 50 may be a permalloy bridge is "barber pole" biased so that no external magnetic bias is required. Power regulator 82 provides the necessary DC voltages for sensor 80, from an AC power bus from a roadside station. Sensor 80 is more economical, though with the tradeoff of being less accurate, than sensor 10 of FIG. 13. Trimmed-down versions of sensor 10 may be used, such with the absence of feedback coil 68 for open loop operation and/or the absence of the reset coil.

We claim:

1. A magnetometer vehicle detector, for a roadway having at least one lane, comprising: at least one magnetometer sensor in each lane; and wherein said magnetometer sensor comprises:

a magnetoresistor bridge, having a sensitive axis, outputting an electrical signal caused by a change of resistance in the magnetoresistor bridge due to a change of an ambient electromagnetic field, the change caused by a presence of a vehicle;

an amplifier connected to said magnetoresistor bridge for outputting an amplified electrical signal indicating the presence or absence of a vehicle;

an integrator connected to said amplifier for outputting an integrated electrical signal indicating the change of the ambient electromagnetic field and the presence or absence of a vehicle;

a feedback coil connected to said integrator and proximate to said magnetoresistor bridge for providing a magnetic feedback to said magnetoresistor bridge;

a reset coil proximate to said magnetoresistor bridge for switching a magnetization axis of said bridge between zero and 180 degrees alternately with respect to the sensitive axis; and a signal line connected to said integrator for conveying the signal indicating the presence or absence of a vehicle.

2. The detector of claim 1 wherein the magnetometer sensor fits into a standard sawcut in the roadway wherein the sensitive axis has a direction that is approximately perpendicular to a common surface of the roadway.

3. A magnetometer vehicle detector for a roadway having first and second surfaces and at least one lane on the first surface comprising:

at least one magnetometer having a sensing axis situated in each lane of the roadway; and wherein:

said magnetometer comprises:

a bridge of magnetoresistors having a sensitive axis and resistance variations caused by changes of an ambient magnetic field caused by an occurring presence of a vehicle;

an amplifier connected to said bridge of magnetoresistors for enhancing voltage changes caused by the resistance variations of said bridge;

an analog-to-digital converter connected to said amplifier;

a signal line connected to said analog-to-digital converter; and a signal processor connected to said signal line;

each said magnetometer fits in and is situated in a sawcut in the roadway at the first surface, having the sensing axis approximately perpendicular to the surface;

at least a portion of each signal line is situated and fits in the sawcut in the roadway; and said amplifier comprises:

an integrator; and a feedback coil, connected to said integrator and proximate to said bridge of magnetoresistors, for providing magnetic feedback to said bridge, for reducing effects of cross-axis sensitivity and non-linearity upon said bridge.

4. The detector of claim 3 further comprising a reset coil proximate to said bridge of magnetoresistors for switching magnetization of said bridge of magnetoresistors relative to the sensitive axis, for reducing effects of thermal drifts and offsets upon said bridge.

5. A magnetometer vehicle detector, for a roadway, comprising at least one magnetometer, situated in the roadway, having four magnetoresistors connected end to end in a form of a bridge having first, second, third and fourth nodes, the first and third nodes connected to a positive and negative voltage supplies, respectively, and the second and fourth nodes connected to inverting and non-inverting inputs of an amplifier, with a direct current provided to the inputs of the amplifier due to a resistance change of the four magnetoresistors caused by a vehicle proximate to or passing near said magnetometer, and resulting in an output signal from the amplifier thereby indicating a presence of the vehicle; and wherein:

each of said plurality of magnetometers has given distances from the other magnetometers along a length of the roadway;

a signal processor that receives groups of output signals having signature characteristics from said plurality of magnetometers which are caused by vehicles proximate to or passing near said plurality of magnetometers, and converts the signals into information of numbers of vehicles and speeds of the vehicles;

said signal processor converts signature characteristics of the signals into classification information on each of the detected vehicles;

said signal processor converts signature characteristics of the signals into classification information on each of the vehicles;

said signal processor comprises:

a multiplexer connected to said plurality of magnetometers;

an analog-to-digital converter connected to said multiplexer; and a microcomputer connected to said analog-to-digital converter; and said microcomputer comprises:

first means, connected to said analog-to-digital converter, for determining first times between peaks of the signals;

second means, connected to first means, for determining vehicle speeds from the first times and the given distances;

third means, connected to said analog-to-digital converter, for determining second times between groups of the signals;

fourth means, connected to said second and third means, for determining vehicle spacings from the vehicle speeds and the second times;

fifth means, connected to said analog-to-digital converter and having predetermined signal threshold values, for determining third times by comparing the signature characteristics of the signals with the predetermined signal threshold values;

sixth means, connected to said fifth means, for classifying the third times into vehicle types; and seventh means, connected to said sixth means, for determining vehicle counts.

6. The detector of claim 5 further comprising a modem connected to said second, fourth, sixth and seventh means.

7. The detector of claim 6 wherein the magnetometers are magnetoresistive detectors.

* * * * *